US008882239B2

(12) United States Patent
Miedema et al.

(10) Patent No.: US 8,882,239 B2
(45) Date of Patent: Nov. 11, 2014

(54) METHOD FOR DETERMINING MAINTENANCE UNIT PERFORMANCE

(71) Applicant: Oce Technologies B.V., Venlo (NL)

(72) Inventors: Mark Miedema, Velden (NL); Bastiaan J. H. Middelbos, Tegelen (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 13/768,524

(22) Filed: Feb. 15, 2013

(65) Prior Publication Data

US 2013/0155141 A1 Jun. 20, 2013

Related U.S. Application Data

(63) Continuation of application No. PCT/EP2011/072922, filed on Dec. 15, 2011.

(30) Foreign Application Priority Data

Dec. 21, 2010 (EP) ..... 10196181

(51) Int. Cl.
*B41J 2/165* (2006.01)
*B41J 29/17* (2006.01)

(52) U.S. Cl.
CPC ..... *B41J 29/17* (2013.01); *B41J 2/16538* (2013.01)
USPC ..... 347/22; 347/23; 347/24; 347/25; 347/26; 347/27; 347/28; 347/29; 347/30; 347/31; 347/32; 347/33; 347/34; 347/35; 347/36

(58) Field of Classification Search
CPC ..... B41J 2/165; B41J 1/16505–1/16588; B41J 2/1707; B41J 2/1714; B41J 2/1721; B41J 2/18; B41J 29/17
USPC ..... 347/22–36
See application file for complete search history.

(56) References Cited

U.S. PATENT DOCUMENTS

| | | | | |
|---|---|---|---|---|
| 5,500,657 | A | 3/1996 | Yauchi et al. | |
| 5,508,722 | A * | 4/1996 | Saito et al. | 347/17 |
| 6,158,839 | A * | 12/2000 | Fukushima et al. | 347/33 |
| 7,328,962 | B2 * | 2/2008 | Higuchi et al. | 347/19 |
| 7,810,898 | B2 * | 10/2010 | Furukawa et al. | 347/21 |
| 8,002,383 | B2 * | 8/2011 | Kachi et al. | 347/33 |
| 8,087,294 | B2 * | 1/2012 | Yoshie | 73/432.1 |
| 8,109,599 | B2 * | 2/2012 | Inoue | 347/33 |

(Continued)

FOREIGN PATENT DOCUMENTS

| | | | |
|---|---|---|---|
| EP | 0955170 | A1 | 11/1999 |
| EP | 2127882 | A1 | 12/2009 |
| WO | 89/02827 | A1 | 4/1989 |

*Primary Examiner* — Laura Martin
*Assistant Examiner* — Jeremy Bishop
(74) *Attorney, Agent, or Firm* — Birch, Stewart, Kolasch & Birch, LLP

(57) ABSTRACT

In a method for determining a maintenance performance of a maintenance unit of an inkjet printing system, the inkjet system comprises an inkjet print head having an orifice surface, the orifice surface comprising an orifice, which orifice is in fluid communication with an ink chamber. The method comprises operating the maintenance unit to perform a maintenance operation on the orifice surface of the inkjet print head and detecting the presence of a wiper element or amount of ink over the orifice by detecting a pressure wave in the ink chamber and analyzing the detected pressure wave to determine the maintenance performance of the maintenance unit.

8 Claims, 2 Drawing Sheets

(56) References Cited

U.S. PATENT DOCUMENTS

| | | | | |
|---|---|---|---|---|
| 8,303,078 | B2 * | 11/2012 | Inoue | 347/33 |
| 8,308,266 | B2 * | 11/2012 | Numata et al. | 347/19 |
| 8,398,206 | B2 * | 3/2013 | Yamamoto et al. | 347/33 |
| 8,444,247 | B2 * | 5/2013 | Shinkawa | 347/19 |
| 2002/0027573 | A1 | 3/2002 | Saito et al. | |
| 2004/0169693 | A1 | 9/2004 | Nakamura | |
| 2004/0252151 | A1 | 12/2004 | Higuchi et al. | |
| 2008/0238990 | A1 * | 10/2008 | Inoue | 347/33 |

* cited by examiner

METHOD FOR DETERMINING MAINTENANCE UNIT PERFORMANCE

CROSS REFERENCE TO RELATED APPLICATIONS

This non-provisional application is a Continuation of International Application No. PCT/EP2011/072922 filed on Dec. 15, 2011, which claims the benefit of European Patent Application No. 10196181.1 filed in Europe on Dec. 21, 2010. The entire contents of all of the above applications are hereby incorporated by reference.

FIELD OF THE INVENTION

The present invention generally pertains to a method for determining a maintenance unit performance of a maintenance unit of an inkjet printer. Further, the present invention relates to an inkjet printer configured to perform such a method.

BACKGROUND ART

A known inkjet printing system has a maintenance unit. The maintenance unit comprises a wiping element configured to occasionally or regularly wipe an orifice surface of an inkjet print head. Such wiping is performed to remove an excess amount of ink, any dirt and/or any other material present on the orifice surface that may disturb accurate droplet ejection from the print head.

Other maintenance methods are also known from the prior art. Such known methods include methods in which (I) a cleaning fluid is provided on the orifice surface for loosening debris and then removing the fluid by wiping, brushing and/or suction and/or (II) ink is purged and the purged ink is received in a waste container, possibly using suction to receive the ink.

A disadvantage of the known printing system is the lack of control of the maintenance unit. If the maintenance unit fails and does not clean the orifice surface as expected, the accuracy of the droplet ejection may deteriorate and the droplet ejection may even fail completely. Thus, a print quality of the printing system deteriorates and a service technician may need to service the printing system. Since the print head is failing, the service technician will replace the print head instead of the maintenance unit that is causing the failure of the print head. As a consequence, the new print head will fail again soon after the replacement, since the maintenance unit is still not cleaning accurately.

Thus, it is desirable to be able to determine the performance of the maintenance unit such that a failing maintenance unit may be detected, preferably even before the accuracy of the droplet ejection starts to deteriorate significantly.

SUMMARY OF THE INVENTION

In an aspect of the present invention, a method for determining a maintenance performance of a maintenance unit in accordance with claim 1 is provided. The method is based on the insight that the presence of a wiper element or an amount of ink over an orifice may be detected inside a print head by detecting a property change inside the print head, e.g. a property of the ink inside the print head. In particular, a pressure wave may be generated in the ink chambers of the print head upon performing the maintenance operation, which pressure wave is dependent on the performance of the maintenance unit. So, detecting such a pressure wave and analyzing the pressure wave enables to determine the performance of the maintenance unit.

Other embodiments include a suction device sucking ink from the nozzle, thereby generating an ink flow through the print head. In such embodiment, the ink flow may be detected and analyzed. In other embodiments, electrical properties or a temperature may be monitored and analyzed. In any case, it is an aspect of the present invention that the maintenance unit, in operation, causes a detectable change of a property in the print head, not the maintenance unit. Note that a property in the print head may be, for example, a property of the print head itself or a property of the ink.

It is noted that herein reference is made to an inkjet printing system. As used herein, the term inkjet should be broadly interpreted, including any printing system configured to eject droplets of a fluid marking material. For example, a printing system for ejecting droplets of a molten metal is known in the art. Such printing system is envisaged and included in the term "inkjet printing system".

The pressure wave may be the result of a maintenance element passing a orifice, thereby generating a pressure wave in the ink in the orifice. Due to the fluid communication between the orifice and the ink chamber such pressure wave may travel to the ink chamber and be detectable there. Such maintenance element may for example be a wiper element, a suction element or an element providing a cleaning fluid, or the like.

In an embodiment, a pressure wave is generated in the ink chamber, e.g. by performing an actuation in the ink chamber. Depending on an actuation signal used, such actuation may or may not result in a droplet being ejected. In any case, due to the generated pressure wave, a residual pressure wave remains. Such a residual pressure wave is influenced by the acoustics of the ink chamber, the orifice and any material present just outside the orifice. Detecting the residual pressure wave and analyzing it, provides sufficient information to determine whether material, such as an amount of ink or a wiper, is arranged over the orifice.

In an embodiment, the detection of the pressure wave is performed simultaneous with the maintenance operation. For example, if a wiper is moved over the orifice surface and such a wiping action over an orifice results in a detectable pressure wave in the ink chamber, the movement of the wiper over the orifices may be monitored closely. In an embodiment, the maintenance operation comprises wiping the orifice surface using a wiper element. Having an amount of ink on the orifice surface, an amount of ink will accumulate on a side of the wiper element. The presence of such an amount of accumulated ink is easily detectable. Therefore, the movement of the wiper element may be paused when the wiper element is expected to be at a predetermined position. Generating a pressure wave in the one or more ink chambers corresponding to the one or more orifices that are expected to be covered by the ink accumulated at said side of the wiper element and detecting and analyzing the residual pressure waves provides sufficient information to determine whether the wiper is at the expected predetermined position. Moreover, it may be determined where the accumulated amount of ink is, it may be determined how large a surface covered by the accumulated ink is, possibly the amount of ink covering each orifice may be determined such that a shape of the accumulated amount of ink is, thereby obtaining information about the wetting properties of the orifice surface.

In a further aspect, the invention provides an inkjet printing system that is configured to perform the method according to the present invention.

In a further aspect, the present invention provides a computer executable program for instructing a computer such as a printing system controller to control a printing system to perform the method according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinafter and the accompanying schematical drawings which are given by way of illustration only, and thus are not limitative of the present invention, and wherein.

DETAILED DESCRIPTION OF THE DRAWINGS

Figure 1A:
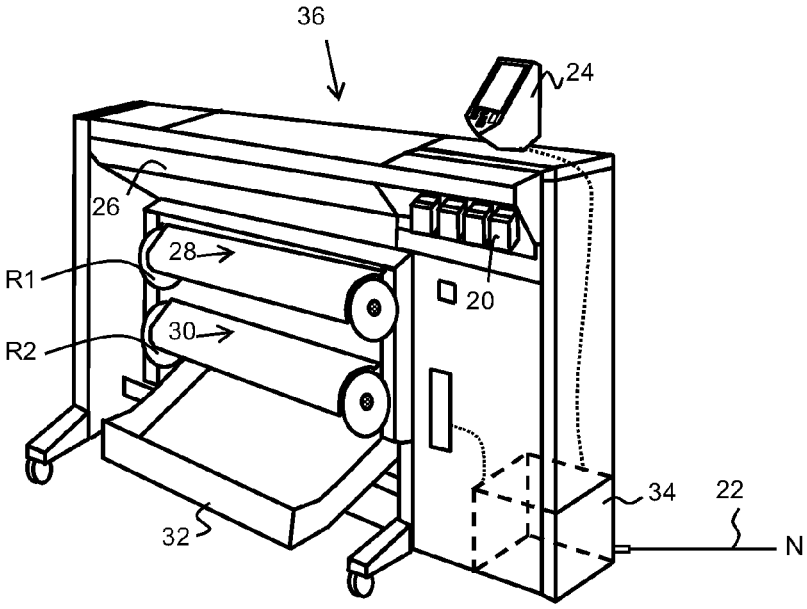
FIG. 1A shows a perspective view of a prior art printing system.

The present invention will now be described with reference to the accompanying drawings, wherein the same reference numerals have been used to identify the same or similar elements throughout the several views.

Figure 1B:
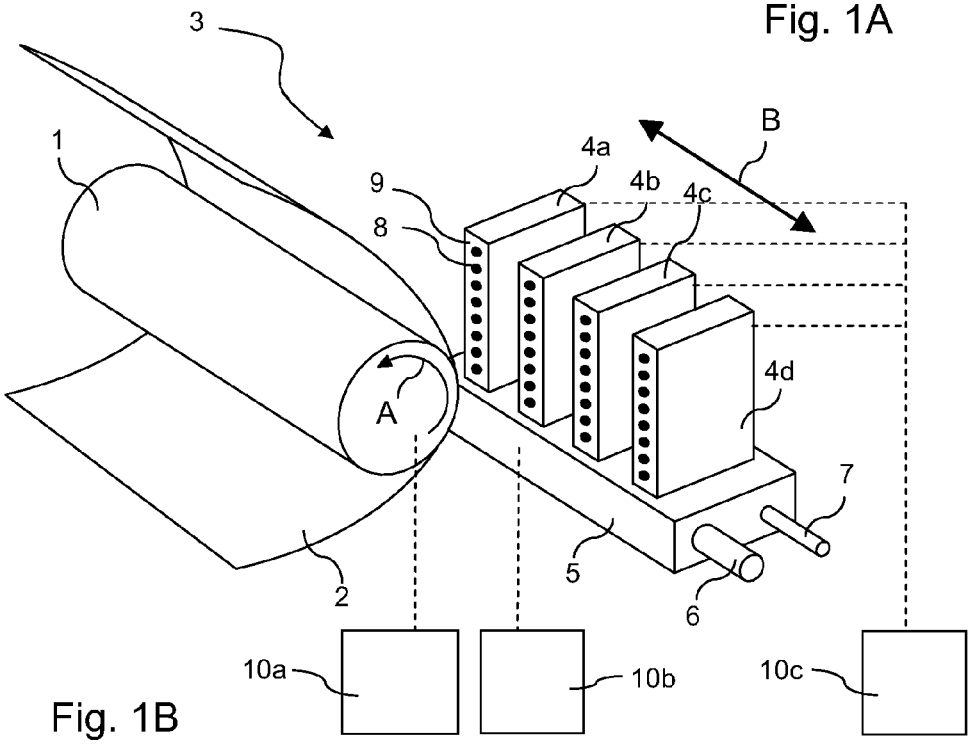
FIG. 1B shows a schematical perspective view of an inkjet printing system, which may be used in the printing system of FIG. 1A.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material. A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove an excess of ink from the orifice surface 9. The excess of ink may be removed for example by wiping with a wiper and/or by application of a suitable anti-wetting property of the surface, e.g. provided by a coating.

Figure 2:
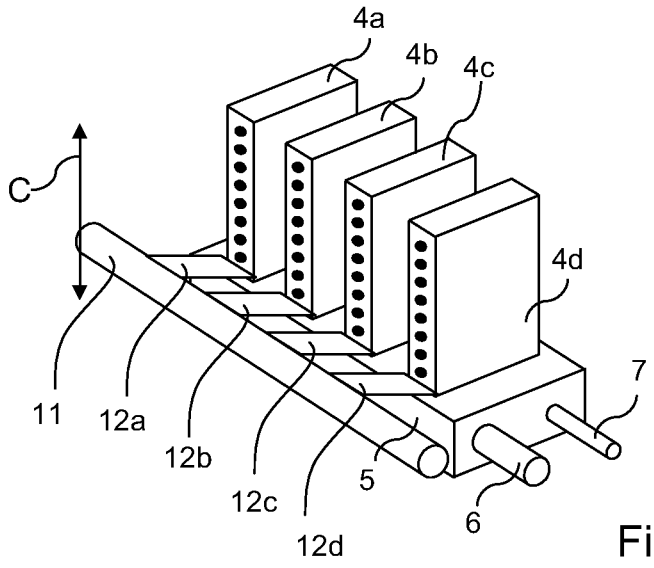
FIG. 2 shows a perspective view of an exemplary maintenance unit comprising a wiper element.

FIG. 2 shows the carriage 5 supporting the four print heads 4*a*-4*d* as shown in FIG. 1B. Further, in FIG. 2, at least a part of an exemplary maintenance unit for cleaning the print heads 4*a*-4*d* is shown. The shown maintenance unit comprises a support element 11 supporting four wiper elements 12*a*-12*d*. Each wiper element 12*a*-12*d* is a flexible sheet-like material that is arranged and configured to be brought into contact with an orifice surface 9 of a respective print head 4*a*-4*d*. The material of the wiper element 12*a*-12*d* may be suitably selected such that the ink used is suitably wiped without causing damage to the orifice surface 9. Also other constraints may be taken into account when selecting the material and other properties and characteristics of the wiper elements 12*a*-12*d*.

Another maintenance unit may comprise similar wiper elements that wipe in another direction, for example. Further, in another embodiment, prior to wiping or other maintenance operation, a cleaning fluid or other suitable fluid may be provided on the orifice surface 9, e.g. for dissolving debris and/or dried ink. In another embodiment, instead of or together with wiping, a suction device may be moved along the orifice surface 9 for sucking fluid and debris and other undesired material from the orifice surface 9. In a particular embodiment, the suction device may even be configured to suck a small amount of ink through the orifice 8 in order to remove any debris and/or dried ink out of the orifice 8 and/or the ink chamber that is in fluid communication with the orifice 8.

Figure 3:
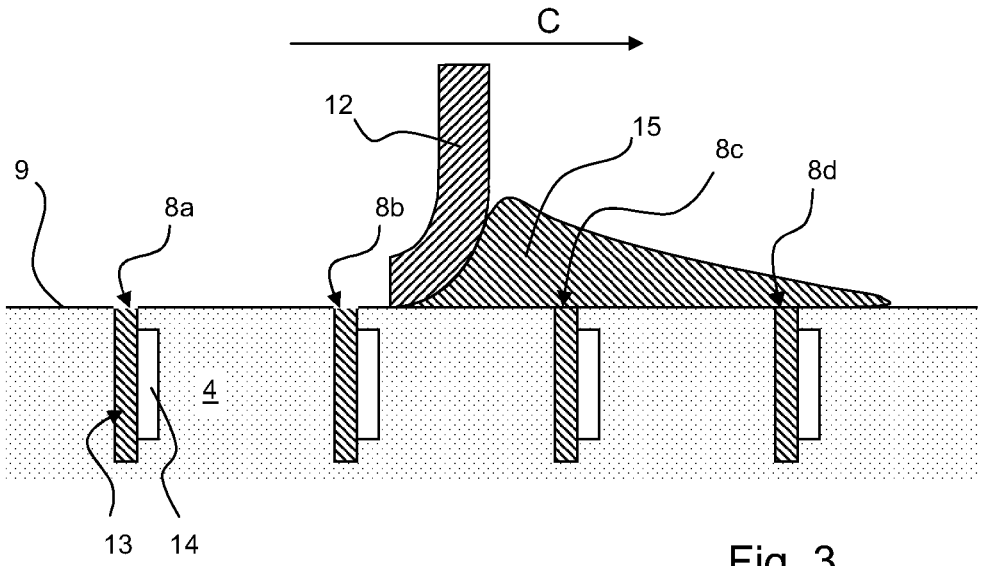
FIG. 3 shows a cross-section of an embodiment of a part of a printing system in accordance with the present invention for illustrating the method according to the present invention.

FIG. 3 illustrates in more detail the operation of a wiper element 12 wiping the orifice surface 9. In the orifice surface 9, a number of orifices are arranged. Four such orifices 8*a*-8*d* (first orifice 8*a*, second orifice 8*b*, third orifice 8*c* and fourth orifice 8*d*) are shown in FIG. 3. Each orifice 8*a*-8*d* is in fluid communication with a schematically shown ink chamber 13 and actuator 14. The actuator 14 may be any suitable element for generating a pressure wave in the ink chamber 13 such that a droplet of ink is expelled through a respective orifice 8*a*-8*d*. Known exemplary actuators include piëzo-electric transducers and heating elements (thermal inkjet principle), but other pressure generating elements may also be employed. The ink chambers 13 are filled with ink 15. Hereinbelow, in the present example, it is assumed that the actuator 14 is a piëzo-electric transducer that may also be used as a pressure sensor, as is well known in the art. If another kind of actuator is used, in order to perform the method according to the invention, a separate pressure sensing element may be provided to detect any pressure change in the ink chamber 13.

An amount of ink 15 may become present on the orifice surface 9 during printing operation due to a number of circumstances. In order to prevent malfunctioning of the inkjet print head, it is known to wipe the orifice surface 9 as hereinabove described. During wiping the ink present on the orifice surface 9 is gathered at a side of the wiper element 12, in particular in front of the wiper element 12 (considered in view of a wiping direction C). Thus, an accumulated amount of ink 15 precedes the wiper element 12. During wiping operation, the wiper element 12 and the corresponding preceding amount of ink 15 is moved over the orifice surface 9 and passes each orifice 8*a*-8*d*. Upon passing one of the orifices 8*a*-8*d* the wiper element 12 generates a pressure change in the corresponding ink chamber 13 that may be detected by the actuator 14. However, if the wiper element 12 is not in contact with the orifice surface 9, for example, such a pressure change does not occur and it may be determined that that the maintenance operation of the wiper element 12 is not performed suitably. Hence, by monitoring (detecting and analyzing) any pressure changes in the ink chambers 13, it is enabled to verify whether or not the wiper element 12 actually performs the desired maintenance operation suitably. Similarly, when spraying a cleaning fluid or when sucking fluid from the orifice surface 9, a pressure change is generated and the maintenance operation may be verified by monitoring any pressure changes.

While a direct pressure change is generated in the ink chambers 13, such a pressure change may be small and difficult to detect directly e.g. due to measurement noise and the like. In such circumstance, in an embodiment, the actuator 14 may be controlled to generate a pressure wave and a residual pressure wave may be detected and analyzed. For example, a residual pressure wave in the ink chamber 13 corresponding to the first orifice 8*a* will be different from a residual pressure wave in the ink chamber corresponding to the third orifice 8*c* due to the amount of ink being present over the third orifice 8*c*. Based on this understanding, it is contemplated that the performance of the wiping operation may be determined during operation either while the wiper element 12 is moving or while the movement of the wiper element 12 is interrupted.

If the performance is determined while the wiper element 12 is moving, all ink chambers 13 are probed (i.e. all actuators 14 are actuated and a pressure change in all ink chambers 13 are detected) simultaneously or, in another embodiment, only a number of ink chambers 13 are probed, wherein the ink chambers 13 are selected based on a position that the wiper element 12 is expected to have at the moment of probing.

In the embodiment wherein the movement of the wiper element 12 is interrupted, all ink chambers 13 may be probed for pressure changes or only a number of ink chambers 13 corresponding to an expected position of the wiper element 12 may be probed.

In a further embodiment, the analysis of the pressure changes in the ink chamber 13 includes determining a property of an element or substance present over the corresponding orifice 8*a*-8*d*. For example, such a property may be a layer thickness of ink 15 present over the orifice 8*a*-8*d*. For example, the thickness of the layer of ink 15 present over the third orifice 8*c* is larger than the thickness of the layer of the fourth orifice 8*d*. By suitable analysis, such layer thickness may be determined and used to determine a shape of the ink 15 accumulated in front of the wiper element 12. Such a shape depends inter alia on wetting properties of the orifice surface 9. If the orifice surface 9 has a good wettability for the ink 15, the ink 15 will easily spread over the orifice surface 9 and will therefore form a relatively thin layer of ink 15 extending over a large range. If the orifice surface 9 is not well wetted by the ink 15, the ink 15 will tend to bead and will form a relatively thick layer extending over a small range. If the orifice surface 9 has been configured to be poorly wetted by the ink 15 by application of a suitable coating, for example, but it is determined from the analysis that the ink 15 preceding the wiper element 12 extends over a large range and forms a relatively thin layer, it may be concluded that such coating has been damaged e.g. due to inappropriate wiping. On the other hand, if the amount of ink extends over a large range and forms a thick layer, it may be concluded that there is indeed a large amount of ink present on the orifice surface 9 and therefore maintenance operations may need to be performed more often or there is a malfunctioning of the print head resulting in an excess amount of ink 15 getting on the orifice surface 9. Hence, it may not only be detected that a maintenance unit does not function at all, it may also be detected that the maintenance unit does not function correctly and/or the print head does not function correctly. Similarly, ink properties, such as viscosity and the like, may be verified. Based on the above described detailed embodiments, the person skilled in the art readily understands that the invention is based on the understanding that a maintenance unit configured to operate on an inkjet print head orifice surface influences the acoustic properties of the ink chambers and/or generates a pressure change in the ink chamber. Both effects, i.e. change of acoustic properties and change of pressure, may be detected and be used for determining a performance of the maintenance unit. Moreover, it is contemplated that other methods may be available for detecting the presence of a wiper element or an amount of ink over an orifice and such method may as well be employed for performing a maintenance performance verification method. For example, electrical properties, mechanical properties and the like may be employed. In an exemplary embodiment, a change in electrical capacitance of the orifice surface may be detected. In other exemplary embodiment, vision systems comprising a camera and image processing capabilities may be used to analyze a change in droplet formation and/or change in ink flow on the orifice surface.

Hence, while detailed embodiments of the present invention are disclosed herein, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term another, as used herein, is defined as at least a second or more. The terms including and/or having, as used herein, are defined as comprising (i.e., open language).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. Method for determining a maintenance performance of a maintenance unit of an inkjet printing system, the inkjet system comprising an inkjet print head having an orifice surface, the orifice surface comprising an orifice, which orifice is in fluid communication with an ink chamber, the method comprising:

a) operating the maintenance unit to perform a maintenance operation on the orifice surface of the inkjet print head;

b) detecting a property change inside the print head; and c) analyzing the detected property change to determine the maintenance performance of the maintenance unit, wherein the step b) is performed simultaneously with performing step a).

2. Method according to claim 1, wherein step b) of the method comprises detecting a pressure wave in the ink chamber; and step c) comprises analyzing the detected pressure wave to determine the maintenance performance of the maintenance unit.

3. Method according to claim 2, wherein step b) comprises b1) generating a pressure wave; and b2) detecting a residual pressure wave.

4. Method according to claim 3, wherein:

step a) comprises wiping the orifice surface using a wiper element, an amount of ink being accumulated at a side of the wiper element;

prior to performing step b), wiping is paused when the wiper element is expected to be at a predetermined position;

generating a pressure wave in at least the ink chambers in fluid communication with the orifices that are located at the predetermined position;

performing step b) in at least the ink chambers in fluid communication with the orifices that are located at the predetermined position; and performing step c) to determine whether the wiper element is actually at the predetermined position.

5. Method according to claim 4, wherein in step c) a position of the ink accumulated at the side of the wiper element is determined.

6. Method according to claim 1, wherein the property change results from a wiper element passing an orifice and/or the property change results from a suction device passing the orifice and/or results from a liquid being provided on the orifice surface.

7. Inkjet printing system comprising an inkjet print head having an orifice surface, the orifice surface comprising a orifice, which orifice is in fluid communication with an ink chamber, and the inkjet printing system comprising a maintenance unit for performing a maintenance operation on the orifice surface, wherein the inkjet printing system is configured to perform the method according to claim 1.

8. Computer readable medium comprising computer executable instructions for instructing a computer to control an inkjet printing system to perform the method according to claim 1, wherein the inkjet printing system comprises an inkjet print head having an orifice surface, the orifice surface comprising a orifice, which orifice is in fluid communication with an ink chamber, and a maintenance unit for performing a maintenance operation on the orifice surface.

* * * * *